US007890223B1

(12) United States Patent
Young

(10) Patent No.: US 7,890,223 B1
(45) Date of Patent: Feb. 15, 2011

(54) RAILROAD SIGNAL ASPECT COMPLIANCE MONITORING SYSTEMS AND METHODS

(75) Inventor: Ralph Young, Osawatomie, KS (US)

(73) Assignee: BNSF Railway Company, Fort Worth, TX (US)

( * ) Notice: Subject to any disclaimer, the term of this patent is extended or adjusted under 35 U.S.C. 154(b) by 882 days.

(21) Appl. No.: 11/804,249

(22) Filed: May 17, 2007

Related U.S. Application Data

(60) Provisional application No. 60/801,441, filed on May 18, 2006.

(51) Int. Cl.
*G06F 7/00* (2006.01)
*B61L 23/00* (2006.01)

(52) U.S. Cl. ..... 701/19; 701/20; 246/1 R

(58) Field of Classification Search ..... 701/19–20; 246/1 R, 1 C, 2 R, 3, 122 R, 124
See application file for complete search history.

(56) References Cited

U.S. PATENT DOCUMENTS 4,085,913 A * 4/1978 Chang ..... 246/63 A
6,179,252 B1 * 1/2001 Roop et al. ..... 246/293
6,631,322 B1 * 10/2003 Arthur et al. ..... 701/211

* cited by examiner

*Primary Examiner*—Yonel Beaulieu
(74) *Attorney, Agent, or Firm*—Thompson & Knight LLP; James J. Murphy

(57) ABSTRACT

A system for remotely monitoring compliance with a railroad signal associated with a section of railroad track includes a remote aspect compliance subsystem for monitoring compliance with an indication for the section of railroad track represented by an aspect of the railroad signal. The remote aspect compliance subsystem selectively generates corresponding compliance messages, which are communicated via a network to server for display and processing.

13 Claims, 4 Drawing Sheets

RAILROAD SIGNAL ASPECT COMPLIANCE MONITORING SYSTEMS AND METHODS

CROSS-REFERENCE TO RELATED APPLICATION

The present application claims priority to Provisional Application Ser. No. 60/801,441, filed May 18, 2006.

FIELD OF INVENTION

The present invention relates in general to railroad signaling, and in particular, to aspect compliance monitoring systems and methods.

BACKGROUND OF INVENTION

Almost every railway system worldwide use trackside signals to ensure safety and maintain an orderly flow of traffic. In North America, signaling is typically implemented using green, red, and yellow electric lights a traditional signal can include a single light or multiple lights, which, depending on the given state of illumination, present a given aspect conveying a particular indication. (These signals can use individual incandescent bulbs and lenses in a single housing for each color, or use searchlight units, which change color using mechanical or electrical mechanisms in response to electrical control signals.)

There are a number of permissive and absolute indications that can be represented by the signal aspect. For example, in a signal employing two vertically aligned signal lights, an aspect with an illuminated green light above an illuminated green light is typically a "clear" indicating that the train crew can proceed along the upcoming block of track. In contrast, an aspect having an illuminated red light over another illuminated red typically indicates an "absolute stop" to the train crew. For a single light signal, an illuminated green light on a signal stanchion, with or without a numbered plate, is typically also a "clear" indicating that the train crew can proceed. On the other hand, a single illuminated red on a stanchion with a numbered plate typically indicates "stop and precede" at restricted speed, while a single illuminated red on a stanchion without a numbered plate typically indicates "absolute stop".

Given the significant need to maintain safety by ensuring compliance with signal aspects, efficient and accurate techniques are necessary for monitoring train crew signal compliance, and particularly "red aspect" compliance.

SUMMARY OF INVENTION

The principles of the present invention are embodied in systems and methods that allow remote compliance monitoring of railroad signal aspects. According to one representative embodiment, a system is disclosed for remotely monitoring compliance with a railroad signal associated with a section of railroad track and includes a remote aspect compliance subsystem for monitoring compliance with an indication for the section of railroad track represented by an aspect of the railroad signal. The remote aspect compliance subsystem selectively generates corresponding compliance messages, which are communicated via a network to server for display and processing.

Embodiments of the present principles advantageously allow a railroad company to remotely monitor train crew signal compliance, and particularly "red aspect" compliance, and thereby improve safety. These improvements are accurate and very efficient to implement and operate.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-4 of the drawings, in which like numbers designate like parts.

Figure 1:
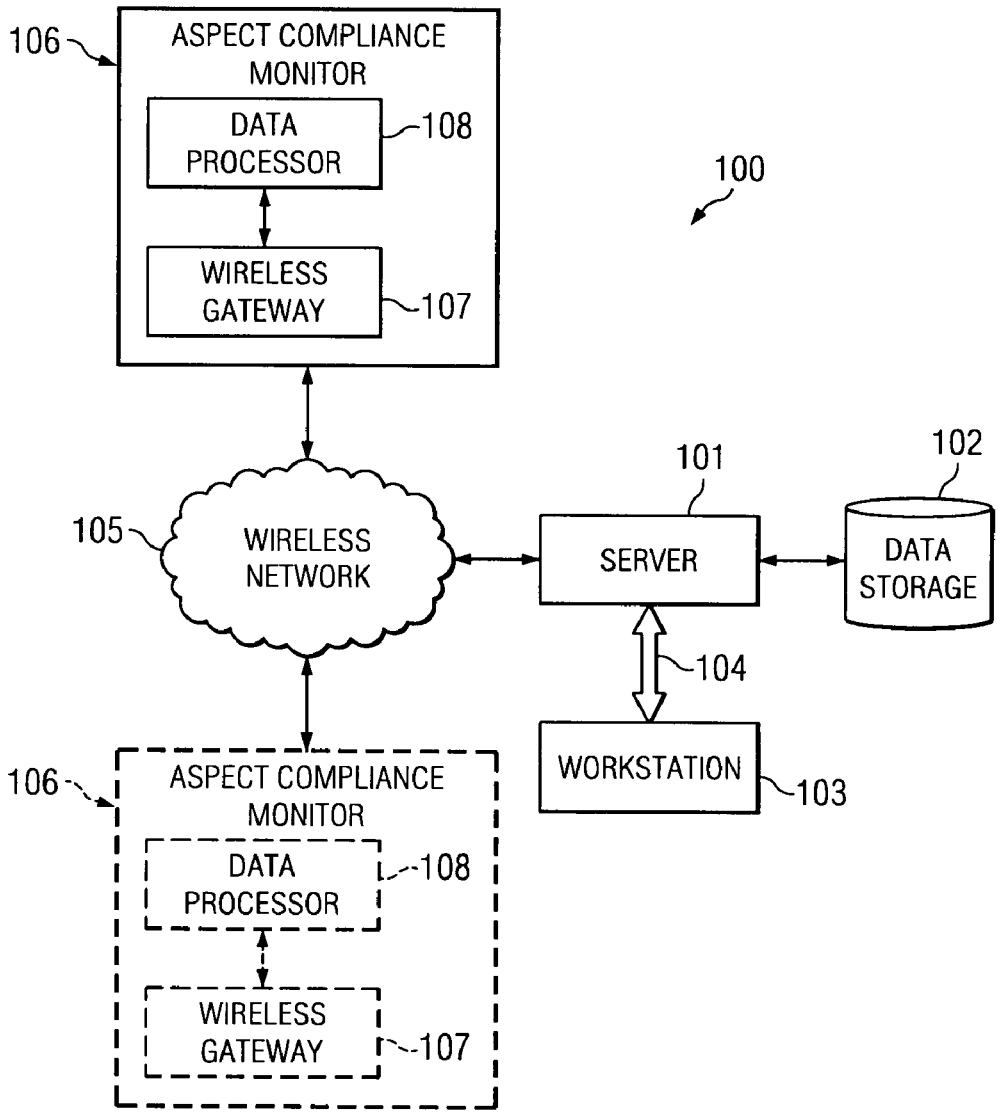
FIG. 1 is a high level diagram of an exemplary networked remote aspect compliance monitoring system embodying the principles of the present invention.

FIG. 1 is a diagram of an exemplary networked remote aspect compliance monitoring system 100 suitable for describing one possible application of the principles of the present invention. Remote aspect compliance monitoring system 100 includes a server 101 and associated electronic data storage 102. A personal workstation or personal computer within a central dispatch or monitoring facility operates in conjunction with server 101 across a local area network (LAN) 104.

In the illustrated embodiment, server 101 also communicates with a wireless communications network 105, such as a GSM network available through a commercial wireless service provider, such as Cingular. At least one, and normally more, aspect compliance monitors 106 also communicate with wireless communications network 105. As will be discussed in detail below, aspect compliance monitor 106 includes a wireless gateway 107 and a data processor 108.

Figure 2:
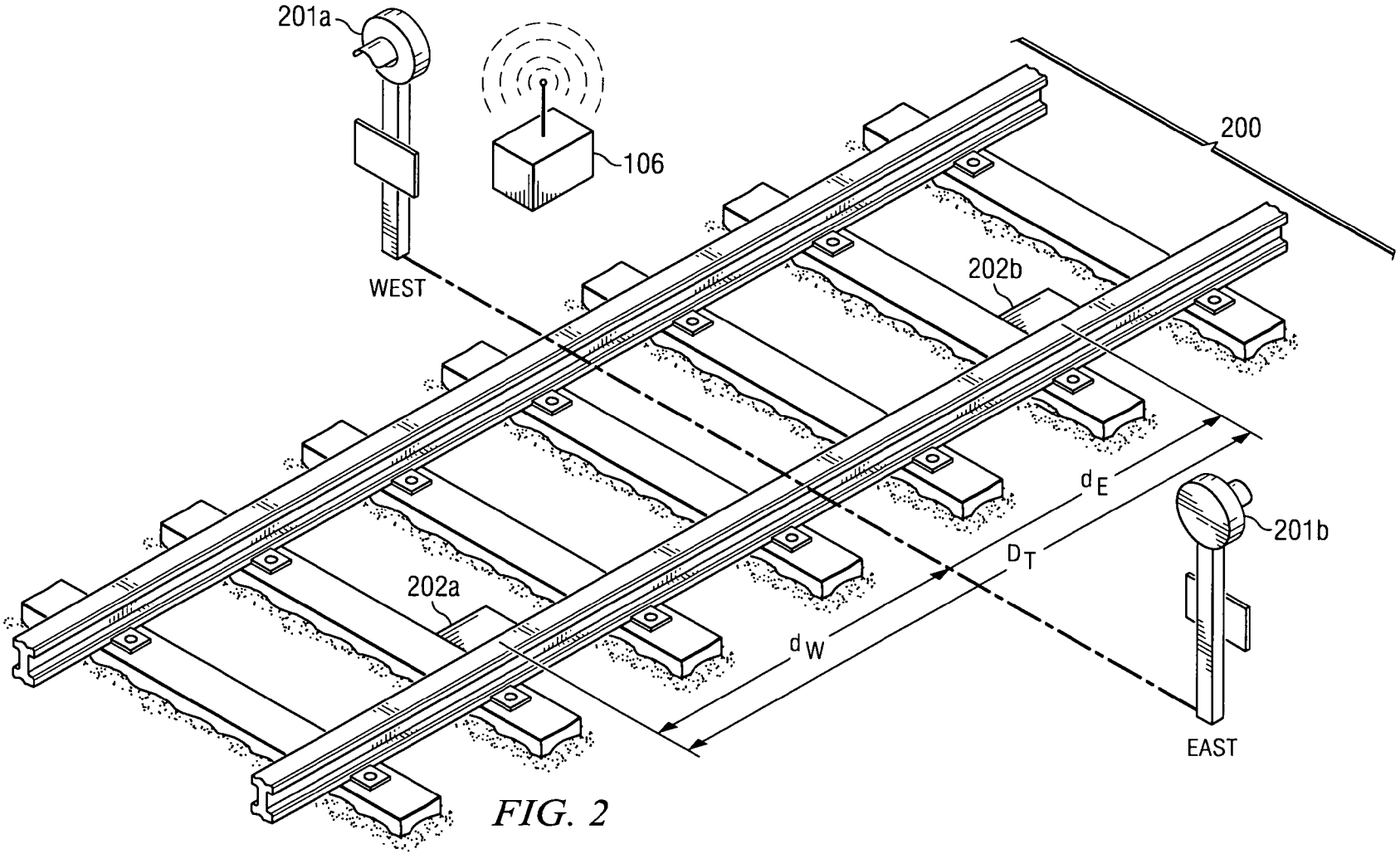
FIG. 2 is a high level drawing of a representative section of railroad track and a pair of associated signals, together suitable for demonstrating a typical application of the system of FIG. 1.

FIG. 2 is a high level diagram drawing of a section of railroad track 200 associated with a pair of signals 201*a* and 201*b*. For discussion purposes, signal 201*a* is the "west" signal, which provides indications for westbound traffic, and signal 201*b* is the "east" signal, which provides indications for eastbound traffic. The designations "west" and "east" are labels for discussion purposes, and do not necessarily correspond to actual navigational directions. In the illustrated embodiment, signals 201*a* and 201*b* are single light signals having a number plate. Additionally, for discussion purposes, signals 201*a* and 201*b* are either single lamp or searchlight units capable of generating a red aspect.

System 100 also includes a west wheel detector 202*a* and an east wheel detector 202*b*. West wheel detector 202*a* is spaced from a centerline running through west signal 201*a* by a distance $d_w$ and east wheel detector 202*b* is spaced from a center line running through east signal 202*b* by distance $d_e$. In the embodiment shown in FIG. 2, both west signal 201*a* and east signal 201*b* are disposed along the same centerline, generally shown by dashes; however, in alternate embodiments, west signal 201*a* and east signal 201*b* could be laterally offset with respects to each other. The total distance between west and east wheel detectors 202*a* and 202*b* is represented as $d_t$ in FIG. 2. Although they will be discussed in detail below, generally, west and east wheel detectors 202*a*-202*b* each generate an electrical pulse when an axle of a locomotive or railcar passes over them.

Generally, aspect compliance monitor 106 is coupled by cables to west and east signals 201*a* and 201*b*. For a locomotive traveling in a given direction, an alarm is sounded and a report is generated when a train crew fails to observe a red aspect condition on the corresponding signal 201*a* or 201*b* and/or passes through a red aspect at a speed above a predetermined limit.

Figure 3:
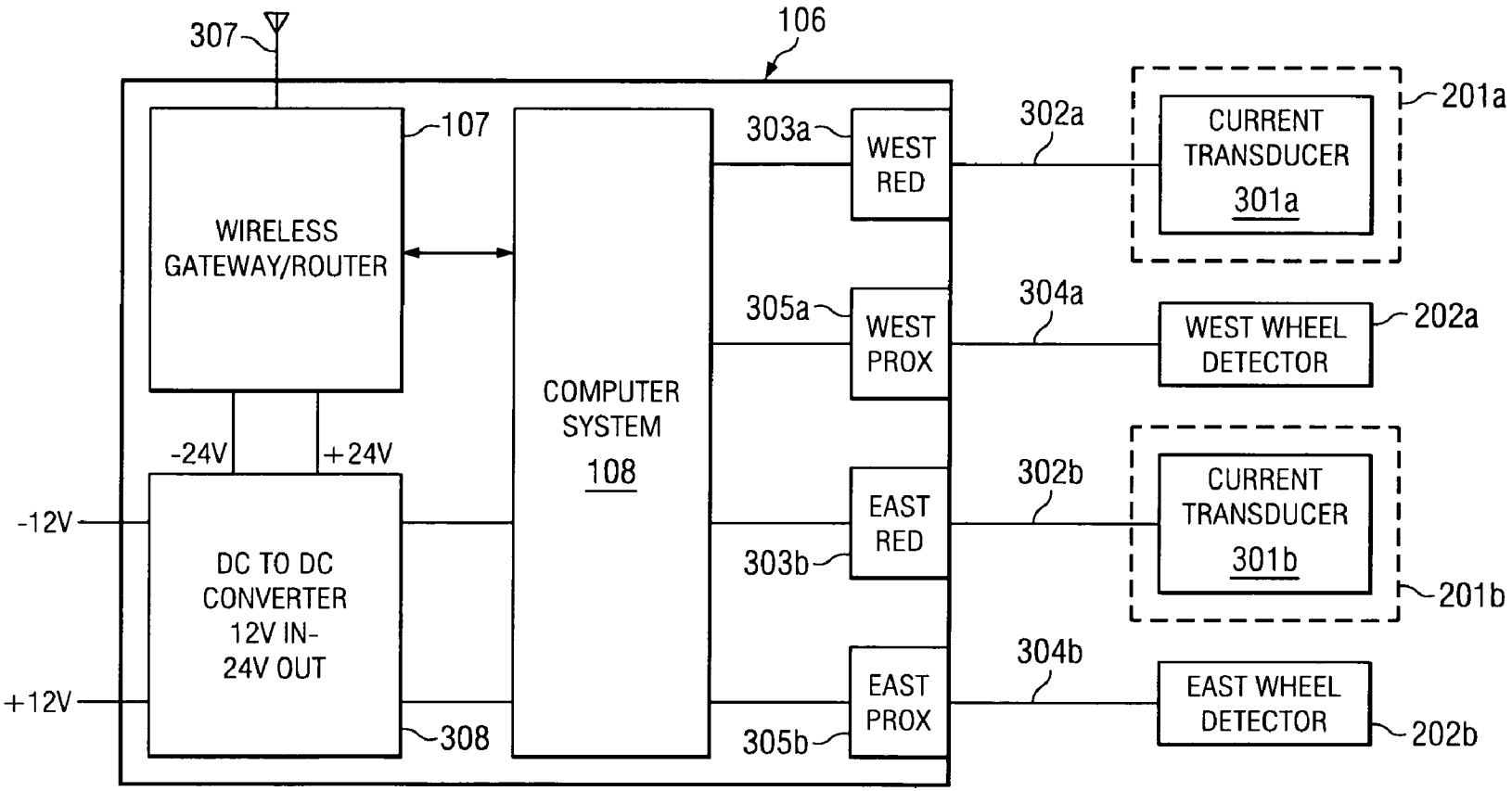
FIG. 3 is a more detailed diagram of the remote aspect compliance monitor shown in FIG. 2.

FIG. 3 is a more detailed diagram of representative aspect compliance monitor 106 of FIG. 2 and its interface with west and east signals 201*a*-201*b*. In the illustrated embodiment, each signal 201*a*-201*b* is associated with a current transducer 301*a*-301*b*. Current transducers 301*a*-301*b* detect when the corresponding signal 201*a*-201*b* transitions to or from a red aspect. For single bulb lights, current transducers 301*a*-301*b* directly detect the current flowing to the signal bulb when the red light is illuminated. For searchlight signals, current transducers 301*a*-301*b* sense the control current used to change the color of the signal light. Suitable current transducers are available from CR Magnetics, Inc., St. Louis, Mo.

Current transducers 301*a*-301*b* respectively connect through cables 302*a*-302*b* to corresponding west red and east red input ports 303*a* and 303*b* on aspect compliance monitor 106.

The signals generated by current transducers 301*a* and 301*b* couple through ports 303*a*-303*b* to computer system 108. Computer system 108 also receives inputs from west wheel detector 202*a* and east wheel detector 202*b* through cables 304*a* and 304*b* in corresponding input ports west prox 305*a* and east prox 305*b*. In the illustrated embodiment, computer system 108*a* is a BL2600 Wolf Ethernet-enabled single board computer available from Z-World. West and east wheel detectors 202*a*-202*b* are preferably WDS2 wheel detectors which clamp on to a rail of selected track section 200, as generally shown in FIG. 2.

Aspect compliance monitor 106 communicates with a central dispatch office through a wireless gateway/router 109 and antenna 307. In the illustrated embodiment, wireless gateway/router 109 is a Digiconnect WAM GSM wide area network (WAN) gateway/router.

Aspect compliance monitor 106 also includes an internal power supply, which is a DC to DC converter 308. In the illustrated embodiment, DC to DC converter is a 12V to 24V converter available from Astrodyne, Taunton, Mass.

Figure 4:
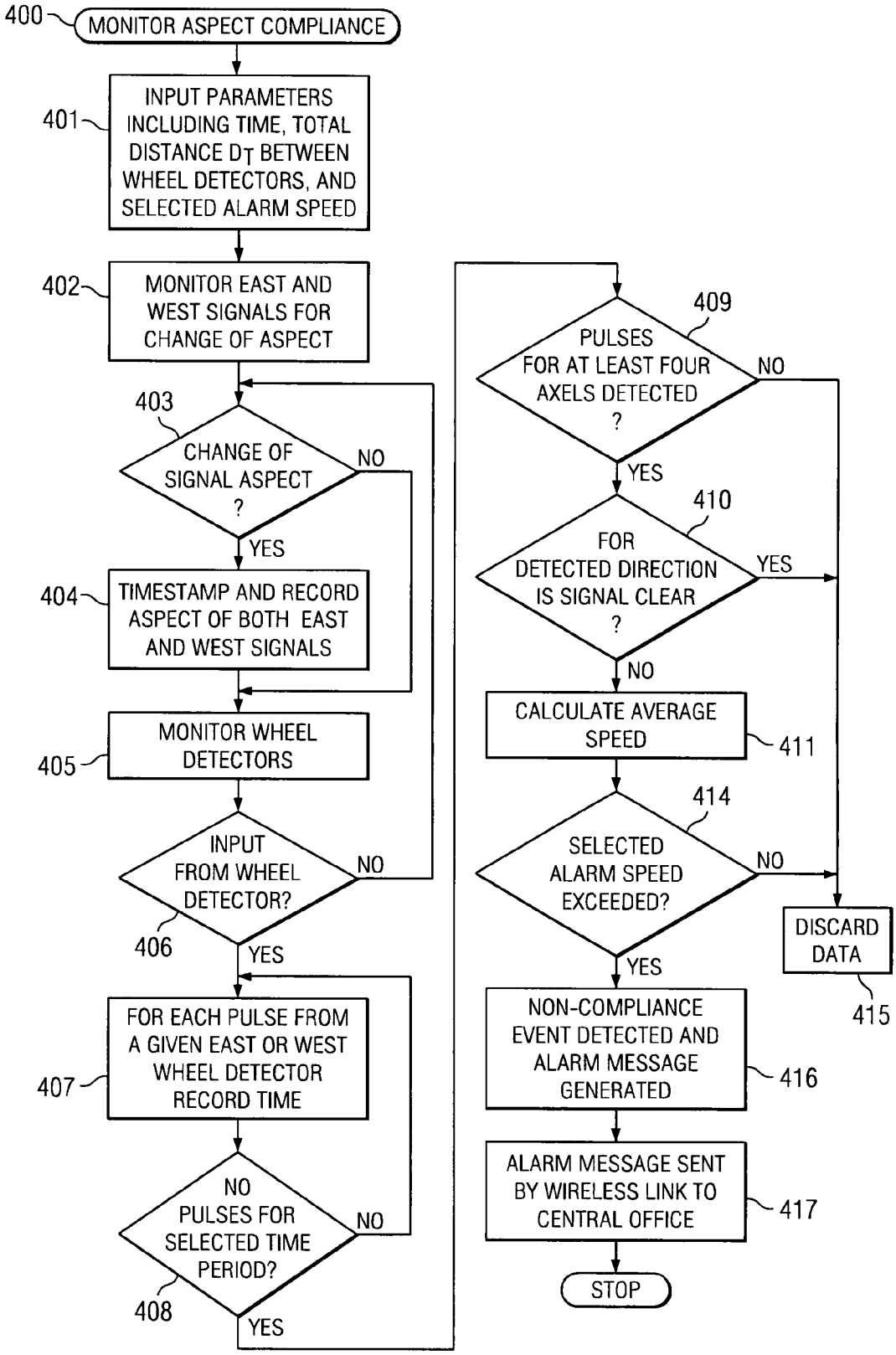
FIG. 4 is a flow chart illustrating a representative remote aspect compliance monitoring procedure according to the principles of the present invention.

FIG. 4 is a flow chart of a preferred aspect compliance monitoring procedure 400 embodying the principles of the present invention. Preferably, monitoring procedure 400 is performed using aspect monitoring system 106 shown in FIGS. 1, 2, and 3, although the principles of the present invention are not necessarily limited thereto.

At block 401, operating parameters, such as the time, the total distance ($D_1$) between west and east wheel detectors 202*a* and 202*b*, and the selected alarm speed are input into computer system 108. The alarm speed represents the maximum speed a train crew may run by a signal 201*a* or 201*b* with a red aspect. West and east signals 201*a* and 201*b* are then monitored at block 402 for a change of aspect.

When, at decision block 403, a change in signal aspect occurs for one or both of west and east signals 201*a*-201*b*, the event is time-stamped and the new states for both of east and west signals are recorded. After the time stamp and aspect states are recorded at block 404, or when no change of signal aspect has occurred at decision block 403, procedure 400 continues to block 405 and wheel detectors west and east 202*a* and 202*b* are monitored for electrical pulses.

If no input is detected from either wheel detector 202*a* or 202*b* at decision block 406, procedure 400 continues to loop back to decision block 403. Otherwise, as each pulse is detected for given west or east wheel detector 202*a* or 202*b*, the time is recorded. Assuming that at least one train axle crosses both detectors 202*a* and 202*b*, the first detector generating a pulse is the origin detector, and the second detector generating a pulse is the destination detector. The direction of movement is determined by the origin detector 202*a* or 202*b*. For example, the first axle on a westbound train will first trigger west wheel detector 202*a*.

Pulse times continue to be recorded at block 407 as long as pulses continue to be generated for a given period of time (e.g. 30 seconds) at decision block 408. Otherwise, when no pulses have been detected for the selected period of time it is assumed that the train has either stopped or passed by wheel detectors 202*a* and 202*b*.

Thereafter, at decision block 409, a determination is made as to whether the pulses for at least four axles have been detected by both east and west detectors 202*a* and 202*b*. If this condition is not met, then procedure 400 jumps to block 415, and the accumulated data are discarded. On the other hand, if at least four axles have crossed both detectors 202*a* and 202*b*, then a determination is made as to whether the signal for the direction of travel is clear (block 410). If the aspect for signal 201*a*-201*b* corresponding to the direction of travel indicates clear, then procedure 400 again jumps to block 415 and the data are discarded. On the other hand, if the corresponding signal has a red aspect, then at block 411, the average speed is calculated. From the calculated average speed, a determination is made at decision block 414 as to whether the calculated average speed exceeds the selected alarm speed. If it has not, then the data are again discarded at block 415. Otherwise, at block 416, a non-compliance event has been detected and alarm message is generated.

The alarm message includes such information as a time stamp; the estimated speed of the train, whether the movement was either an east move or a west move, and the total axle count. The alarm message is then sent to the central office, preferably via network 105 of FIG. 1.

The calculation of the average speed at block 411 can be performed using a number of different methods. In the preferred method, two software arrays are generated, one for the original detector and one for the destination detector. The entries in each array are indexed in accordance with the order in which pulses are received from the corresponding detector and store the time accumulated since the first pulse generated by the origin detector. Hence, the first entry in the origin array represents the time that the first pulse was generated when the first axle crosses the origin detector, and is always populated with a zero. The first entry in the destination array, which is paired with the first entry in the origin array, is populated the time the first axle crosses the destination detector. Similarly, the second entry in the origin array is populated with the time the second axle crosses the origin detector and the second entry in the destination array represents the time the second axle crosses the destination detector, and so on.

In the illustrated embodiment, the average speed is calculated when at least four pairs of entries have been generated (i.e. at least four axles have crossed both the origin and destination detectors, as discussed above). For each pair of entries, the difference between the populated times is taken. The average speed is then calculated by dividing the sum of all the calculated time differences by the total number of axles (i.e. the number of pairs of entries).

While the principles of the present invention have been described using red aspect compliance monitoring as an example, these principles are equally applicable to monitoring compliance with all signal aspects, including green and yellow.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A system for remotely monitoring compliance with a railroad signal associated with a section of railroad track, comprising:

a remote aspect compliance subsystem for monitoring compliance with an indication for the section of railroad track represented by an aspect of the railroad signal and selectively generating a corresponding compliance message, wherein the aspect is a red aspect and the remote aspect compliance monitor generates a compliance message when a train crew runs-by the red aspect at a speed exceeding a predetermined maximum speed limit, the remote aspect compliance subsystem comprising:

a signal aspect detector for determining the current aspect of the railroad signal;

a set of wheel detectors for detecting movement of a train in the section of railroad track proximate the railroad signal;

a processor for determining from the current aspect of the railroad signal and signals from the wheel detectors compliance with the indication provided by the current aspect and selectively generating a message in response; and a communications unit for transmitting generated messages to a server; and the server communicating with the remote aspect compliance subsystem via a network for receiving and processing compliance messages received from the remote aspect compliance unit.

2. The system of claim 1, wherein the server communicates with the remote aspect monitoring subsystem using a wireless network.

3. The system of claim 1, wherein the server communicates with the remote aspect monitoring subsystem using the TCI/IP protocol.

4. The system of claim 1, wherein the set of wheel detectors comprises first and second spaced apart wheel detectors in the section of track proximate the railroad signal and the processor is further operable to:

detect a selected number of train axels crossing the first and second spaced apart wheel detectors;

from the detected train axel crossings, estimating a train speed for the train passing the railroad signal; and generating a message when the estimated train speed exceeds a predetermined threshold train speed.

5. The system of claim 1, wherein the signal aspect detector comprises a current transducer detecting bulb current flow within the signal.

6. The system of claim 1, wherein the signal aspect detector comprises a current transducer for detecting control current flow within the signal.

7. The system of claim 1, further comprising a workstation coupled to the server for displaying messages received from the aspect monitoring subsystem.

8. A railroad signal aspect compliance monitoring system comprising:

a central office including a server and at least one workstation;

at least one remote monitoring subsystem for monitoring compliance with an indication provided by an aspect presented by at least one railroad signal, comprising:

a signal aspect detector for detecting the aspect of the railroad signal;

first and second spaced apart wheel detectors for detecting movement of a train within a section of track proximate to the railroad signal;

a processor for determining from the detected aspect and signals received from the wheel detectors compliance with the indication provided by the detected aspect and selectively generating a message in response, wherein the detected aspect is a red aspect and the remote aspect compliance monitor generates a compliance message when a train crew runs-by the red aspect at a speed exceeding a predetermined maximum speed limit as detected by the wheel detectors; and a wireless communications unit for transmitting generated messages wirelessly to the central office server for selective display on the workstation.

9. The aspect compliance monitoring system of claim 8, wherein the processor is further operable to:

detect a selected number of train axels crossing the first and second spaced apart wheel detectors;

from the detected train axel crossings, estimating a train speed for the train passing the railroad signal; and generating a message when the estimated train speed exceeds a predetermined threshold train speed.

10. The aspect compliance monitoring system of claim 8, wherein the at least one railroad signals comprises one of a pair of signals each providing an indication to trains traveling in different directions along the section of track.

11. The aspect compliance monitoring system of claim 8, wherein the wireless communications unit comprises a GSM wireless gateway.

12. The aspect compliance monitoring system of claim 8, wherein the wireless communications unit exchanges information with the server using the TCI/IP protocol.

13. The aspect compliance monitoring system of claim 8, wherein the signal aspect detector comprises a current transducer monitoring a selected current from which the at least one railroad signal operates.

* * * * *